United States Patent [19]

Frohn et al.

[11] Patent Number: 4,792,389

[45] Date of Patent: Dec. 20, 1988

[54] PROCESS TO PRODUCE LIGHT PRODUCTS AND FUEL OILS FOR CONVENTIONAL USE FROM HEAVY METAL- AND SULFUR-RICH CRUDE OIL RESIDUES

[75] Inventors: Werner Frohn; Dieter Bohlmann; Hermann Franke; Werner Zimmermann; Heinz Limmer; Eberhard Höpfner; Horst Lindner; Reinhard Matthey; Henner Müller; Hans Poppen; Hartmut Schütter, all of Schwedt/Oder; Detlev Dietrich, Vierraden, all of German Democratic Rep.

[73] Assignees: VEB Petrochemisches Kombinat Schwedt, German Democratic Rep.; Toyo Engineering Corporation; Mitsui Coke Co., Ltd., both of Tokyo, Japan

[21] Appl. No.: 45,909

[22] Filed: May 1, 1987

[30] Foreign Application Priority Data

Jun. 10, 1986 [DD] German Democratic Rep. ... 291132

[51] Int. Cl.[4] ..... C10G 51/02

[52] U.S. Cl. ..... 208/76; 208/72; 208/130

[58] Field of Search ..... 208/67, 72, 75, 76, 208/106, 130

[56] References Cited

U.S. PATENT DOCUMENTS

| | | | |
|---|---|---|---|
| 2,100,048 | 11/1937 | Beatie | 208/76 |
| 2,166,787 | 7/1939 | Alther | 208/76 |
| 2,247,740 | 7/1941 | Angell | 208/75 |
| 2,363,237 | 11/1944 | Harvey, Jr. | 208/75 |
| 2,748,061 | 5/1956 | Olberg et al. | 208/76 |
| 3,148,136 | 9/1964 | Woodle | 208/69 |
| 4,268,375 | 5/1981 | Johnson et al. | 208/72 |
| 4,487,686 | 12/1984 | Gomi et al. | 208/67 |
| 4,663,022 | 5/1987 | Gomi et al. | 208/75 |

*Primary Examiner*—Anthony McFarlane

*Attorney, Agent, or Firm*—Flynn, Thiel, Boutell & Tanis

[57] ABSTRACT

The invention describes a process for producing light products, such as engine and diesel fuels, and fuel oils for conventional use by thermal conversion of heavy metal- and sulfur-rich-crude oil residues. Thermal cracking of the residues is done by mild cracking in several stages, where the residue remaining after separation of the conversion products of the preceding stage is fed to the respective subsequent stage.

2 Claims, No Drawings

PROCESS TO PRODUCE LIGHT PRODUCTS AND FUEL OILS FOR CONVENTIONAL USE FROM HEAVY METAL- AND SULFUR-RICH CRUDE OIL RESIDUES

RANGE OF APPLICATION OF INVENTION

The invention concerns a process for production of light products such as diesel oil and gasoline and fuel oils for the conventional use by thermal conversion of heavy metal- and sulfur-rich-crude oil residues.

CHARACTERISTICS

The conversion processes for conversion of heavy crude oil residues into valuable light products such as diesel oil and gasoline constantly gain in importance with sinking primary crude oil processing.

Conventional catalytic cracking units (FCC) and hydrocrackers are usually only suitable for clean distillate feedstock. In many cases however such feedstock is not available anymore in sufficient quantities.

A principle for conversion of heavy hydrocarbons applied practically over many years is the thermal cracking. Depending on the type of the treatment, differentiation is made between the so-called Coking Processes (Hydrocarbon Processing Vol. 59, No. 9, Sep. 1980, p. 153), which produces considerable coke quantities of more or less bad quality depending on the feed quality, and the mildly cracking Visbreaking Processes (Hydrocarbon Processing, Vol. 59, No. 9, Sep. 1980, p. 158). It is difficult or even impossible to market the petrol coke produceable from the presently available sulfur- and metal-rich crude oil residues. Also the application of the new thermal cracking process described in the Japanese Patent application Nos. 56 - 3921, 56 - 93011, 56 - 169427 as well as in the DD-AP Nos. 201 804, 202 446, 207 923 and 208 817 and the application of the new process introduced at the Third International Conference for heavy Crude Oils and Tar-sands of 22–31/7/1985 in Long Beach under the title "HSC-ROSE/DESUS-High Conversion Upgrading of extra heavy oils by a new process combination" produces residues, which can not be handled in conventional fuel oil firing facilities, so that in many cases only mild cracking such as with visbreaking of, for example, crude oil vacuum residue into lower-viscous fuel oil is possible. Used as a measure of the cracking intensity (range) are mainly the obtained viscosity reduction in the product against the feed as well as the conversion in percent of formed light parts, for example, boiling under 500° C.

With the presently known thermal cracking processes, which still yield useable fuel oil as a product, only relatively low conversion rates are achieved, which, depending on the feedstock quality and the process are approximately between 20 and 30% referred to 500° C.

A visible increase in the conversion rate, for instance by intensifying the reaction conditions is not possible with the known processes even if many problems are put up with during practical operation of a visbreaker, due in particular to strongly increasing coking tendency, as the produced visbreaker fuel oil becomes unstable and can not be handled anymore.

These problems are analysed by many researchers and/or companies and there are reports thereon by e.g. Gädda in the Oil & Gas Journal dated 10/18/1982, page 120–122 as well as by Lewis among others in Oil & Gas Journal dated 4/8/1985, page 73–81. According to Gädda visbreaker feedstocks are considered as colloidal systems. The asphaltenes contained therein are highly molecular hydrocarbons with a high C/H ratio. They moreover contain sulfur, nitrogen and oxygen. The asphalt core in the center of a micelle is surrounded by components with increasing C/H ratio. the maltene phase. In a stable residue this colloidal micelle is in physical equilibrium with the oil phase, i.e. the asphaltenes are peptised in the maltene phase.

This colloidal stability is disturbed during thermal cracking. The continuous oil phase is cracked into smaller molecules. The change in the maltene phase can reach a point, at which the absorption forces between the asphaltenes and the maltene resins are reduced to such an extent, that the asphaltenes tend to flocculate. At this point the visbreaking fuel oils are unstable leading to sludge formation.

As practical evaluation criteria for the stability of conversion fuel oils according to Lewis etc. in Oil & Gas Journal of 4/8/1985, page 73–81, many fuel oil producers and consumers apply the methods for determination of the existing dry sludge and of the dry sludge after accelerated ageing with hot filtration, which are also described in the above mentioned publication. Fuel oils are considered stable, if the existing dry sludge is 0.15 wt. % or less and the difference between existing dry sludge and dry sludge after accelerated ageing is 0.04 wt. % or less. As reported in Gädda ("Visbreaking as related to the blending technology of its products", lecture at the 2nd International Conference for heavy Crude Oils and Tar-sands, 1982, Caracas, Reprint Chapter 134, p. 1258–1261), the stability of conversion fuel oils can not be improved by blending with other products or fractions, on the contrary, there is even a hazard that still stable conversion oils become instable when blended with other products.

Visbreaking units therefore are operated at the limit of product useability with a more or less great safety factor and the possibilities of an increase in conversion with presently known means is essentially the reduction of this safety factor (gap) by improved operation control and monitoring as well as in optimizing the operation conditions. Thus the difference with reference to the same feedstock between the individual known processes as well as the possible improvements are only within a range of 1–2% conversion.

According to the present and future requirements for further upgrading of crude oil this result is unsatisfactory for refineries and there are many requests and requirements for considerable improvement of the conversion rates in processing the crude oil residues.

SCOPE OF INVENTION

It is the scope of the invention to make available a process for the production of light products and fuel oils for conventional use with essentially improved technical-economical parameters, particularly with a high distillation yield by thermal conversion of heavy metal- and sulfur-rich crude oil residues.

DESCRIPTION OF CHARACTERISTICS OF INVENTION

The task of the invention is to essentially increase as compared to conventional processes the distillation yield of economical thermal conversion of heavy metal- and sulfur-rich crude oil residues while simultaneously producing still conventionally useable fuel oil by new technical-technological solutions.

The task is done with this invention by mild thermal cracking of the heavy residue in several stages, where the remaining residue after separation of conversion products of the preceding cracking stage is fed to the respective subsequent cracking stage, and where the reaction of every preceding thermal cracking stage is conducted under higher pressure and temperature but with less retention time than those for the subsequent thermal cracking stage.

A high efficiency is obtained in two cracking stages, where the first cracking stage is to be operated at approx. 1 MPa and the second stage at nearly atmospheric pressure and with a temperature of approx. 25° C. less than, as well as approx. three times the retention time, that of the first stage. Favorable conditions are approx. 425° C. and 20 min retention time with approx. 15% steam addition as referred to the use in the second stage.

If the viscosity of the remaining residue is too high for the combustion systems which are already outdated in many cases, then this can be reduced to the required value by blending it with FCC cycle oil, at least partially coming from the catalytic cracking of the heavy distillate fraction from the 2-stage mild thermal cracking which was previously hydro-catalytically treated.

Test Examples

A crude oil residue produced by vacuum distillation with the following specification

| | | |
|---|---|---|
| Density at 15° C. | (kg/l) | 1.011 |
| Solidification point | (°C.) | 42 |
| Conradson carbon | (wt. %) | 18.3 |
| Viscosity at 130° C. | (cSt) | 182 |
| Hexane solubles | (wt. %) | 8.1 |
| Sulfur | (wt. %) | 3.12 |
| Nitrogen | (wt. %) | 0.86 |
| Nickel | (wt-ppm) | 74 |
| Vanadium | (wt-ppm) | 195 |

was subjected to thermal cracking according to the visbreaking principle. By varying the parameters a maximum conversion was tried. The following results were obtained:

| Test | 1 | 2 | 3 | 4 |
|---|---|---|---|---|
| Temperature, °C. | 415 | 421 | 430 | 420 |
| Retention time, min | 20 | 20 | 20 | 42 |
| Pressure, MPa | 1 | 1 | 1 | 1 |
| Conversion 500° C.-, wt. % | 18.2 | 26.3 | 32.5 | 32.8 |
| Quality of conversion residue | | | | |
| Existing dry sludge according to hot filtration test wt. % | <0.15 | <0.15 | 0.45 | 0.41 |
| Yield of distillates obtained by atmospheric distillation wt. % | 6.7 | 11.6 | 16.5 | 16.9 |
| Expected operation time until required decoking, days | >350 | 250 | 15 | 15 |

The test data show that a conversion of more than 25 wt. % with reference to 500° C. is possible with the available feed product. Conversion rates above 30% however can not be achieved by conventional visbreaking with satisfactory results. The quantity of light products to be produced by atmospheric distillation from the conversion product is relatively low. Though the distillate quantity can be increased by a downstream vacuum distillation, the cost for this is considerable, which even exceeds the resulting effect in many cases.

In another test series a sample of the same crude oil residue was subjected to the invented two-stage mild thermal cracking with intermediate separation of conversion products with the following results:

| Test | 5 | 6 |
|---|---|---|
| Temperature, °C. | | |
| 1. Stage | 424 | 425 |
| 2. Stage | 400 | 400 |
| Pressure, MPa | | |
| 1. Stage | 1 | 1 |
| 2. Stage | 0.106 | 0.106 |
| Retention time, min | | |
| 1. Stage | 20 | 20 |
| 2. Stage | 60 | 55 |
| Steam injection in the second stage wt. % based on feed | 15 | 15 |
| Separation of conversion products after 1. Stage wt. % based on feed | 18 | 25.5 |
| Overall conversion wt. % 500° C.- | 54.4 | 58.5 |
| Quality of residue after 1. Stage, wt. % existing dry sludge in hot filtration test | <0.15 | <0.15 |
| Quality of residue after 2. Stage - difference of dry sludge after accelerated ageing to existing dry sludge in hot filtration test, wt. % | 0.04 | 0.02 |
| Sulfur, wt. % | 2.99 | 3.06 |
| Viscosity at 225° C., cSt | 42 | 45 |
| Distillation yield by atmospheric distillation referred to feed, wt. % | | |
| $C_5$-200° C. | 6.2 | 6.0 |
| 200-350° C. | 21.5 | 20.6 |
| 350-500° C. | 23.8 | 29.1 |
| Total Distillate | 51.5 | 55.7 |

The results of the test series of this invention show, that considerable improvement of the yield of light products with a satisfactory residue quality for use as a conventional fuel oil can be achieved. The comparison of the tests 5 and 6 shows, that as much separation of the conversion product as possible from the 1. stage is particularly advantageous and causes, even under slightly milder conditions in the 2. stage, a slight improvement of the overall conversion and especially a further shift of the product structure in favor of the fraction 350°-500° C., which is highly desirable to achieve high yields in engine fuels by coupling thermal cracking with catalytic cracking according to the FCC principle including hydrocatalytic pretreatment.

In modern fuel oil firing systems, residues with viscosities of over 40 up to 50 cST can be used, which—in case of usual preheating to 225° C.—are the values of the residues of tests 5 and 6.

The following example however also shows a possibility of viscosity adjustment for older systems and/or other users by blending with FCC cycle oil originating from catalytic cracking of a previously hydro-catalytically treated mixture from the heavy distillate fraction of two-stage mild thermal cracking according to test 6 and vacuum distillate distilled from crude oil.

| Test | 7 | 8 |
|---|---|---|
| Residue from test 6 wt. % | 88 | 74 |
| Cycle oil, wt. % | 12 | 26 |
| Quality of fuel oil mixture | | |
| Viscosity at 70° C., cSt | 4120 | 356 |
| at 100° C., cSt | 1377 | 144 |
| at 225° C., cSt | 15 | — |
| Sulfur, % | 2.75 | 2.45 |
| Hot filtration test existing dry sludge, wt. % | <0.15 | <0.15 |
| Difference of dry sludge after accelerated ageing and existing dry sludge, wt. % | 0.01 | 0.02 |

The tests 7 and 8 prove, that by the proposed blending alternatives, fuel oil for boiler firing systems, which only allow viscosities of approx. 15 cST, can be produced while also considerably stricter viscosity requirements, such as exist for instance for so-called bunker fuels, can be fulfilled without storage stability problems.

What is claimed is:

1. In a two stage process for producing light oil products and conventionally usable fuel oils by the thermal conversion of heavy metal and sulfur-rich crude oil residues, the improvement comprising thermally cracking the residues in a first and a second cracking stage, wherein the residue remaining in the first cracking stage after separation of conversion products is employed as feed to the second cracking stage and the first cracking stage operates at a pressure of about 1 MPa and a temperature of about 425° C. and the second cracking stage operates at a pressure of about 0.1 MPa and a temperature of about 25° C. lower than that of the first stage and with 15 wt. % steam injection in said second stage, said steam wt. % being based on the feed to the second stage, the retention time in the first cracking stage being about 20 minutes and the retention time in the second cracking stage being about three times that of the first cracking stage.

2. A process as claimed in claim 1, wherein the viscosity of the residue remaining in the first cracking stage is adjusted by blending it with an oil, at least part of said oil being produced from the catalytic cracking of a distillate fraction, said distillate fraction having been produced from said two-stage thermal cracking process.

* * * * *